United States Patent [19]

Aral et al.

[11] Patent Number: 4,680,089

[45] Date of Patent: Jul. 14, 1987

[54] PROCESS FOR CONTROLLING THE FORMATION OF SHEET MATERIAL

[75] Inventors: Gurcan Aral, Palo Alto; Ramesh Balakrishnan, Cupertino, both of Calif.

[73] Assignee: Measurex Corporation, Cupertino, Calif.

[21] Appl. No.: 898,859

[22] Filed: Aug. 20, 1986

Related U.S. Application Data

[63] Continuation of Ser. No. 693,920, Jan. 22, 1985, abandoned, which is a continuation-in-part of Ser. No. 646,676, Sep. 4, 1984, abandoned.

[51] Int. Cl.[4] ..... D21F 7/06; D21F 1/06

[52] U.S. Cl. ..... 162/198; 162/259; 162/262; 264/40.5; 364/471; 425/141

[58] Field of Search ..... 162/259, 262, 263, 344, 162/345, 346, 347, DIG. 11, 192, 198; 364/471; 222/55; 425/141; 264/40.1, 40.5, 40.7

[56] References Cited

U.S. PATENT DOCUMENTS

| | | | |
|---|---|---|---|
| 3,413,192 | 11/1968 | Beecher | 162/262 |
| 4,124,342 | 11/1978 | Akatsuka et al. | 425/141 |
| 4,374,703 | 2/1983 | Labeau | 162/262 |
| 4,406,740 | 9/1983 | Brieu | 162/259 |
| 4,409,160 | 10/1983 | Kogo et al. | 425/141 |
| 4,507,073 | 3/1985 | Shelton | 425/141 |
| 4,514,348 | 4/1985 | Iguchi et al. | 425/141 |

FOREIGN PATENT DOCUMENTS

| | | | |
|---|---|---|---|
| 75782 | 4/1983 | European Pat. Off. | 162/344 |
| 2654602 | 6/1978 | Fed. Rep. of Germany | 162/259 |

*Primary Examiner*—Kenneth M. Schor
*Assistant Examiner*—K. M. Hastings
*Attorney, Agent, or Firm*—Hal J. Bohner

[57] ABSTRACT

A process is provided for controlling a thickness regulating member such as a slice lip coupled to slice rods. The process includes determining the desired configuration of the slice lip and determing the required slice rod movements based upon physical characteristics of the slice lip and the slice rods.

5 Claims, 3 Drawing Figures

PROCESS FOR CONTROLLING THE FORMATION OF SHEET MATERIAL

This application is a continuation of prior co-pending application Ser. No. 693,920 filed Jan. 22, 1985, now abandoned, which is a continuation-in-part of prior co-pending application Ser. No. 646,676 filed Sept. 4, 1984, now abandoned.

BACKGROUND OF THE INVENTION

1. The Field of the Invention

The present invention concerns a system and process for controlling the formation of sheet materials such as paper.

2. State of the Art

Various sheet materials are manufactured by causing the material in a fluid state to flow in a controlled fashion onto a conveyer or the like. For example, sheet plastic is often manufactured by extruding heated plastic through a die onto a conveyer belt. Likewise, paper is often manufacture by causing a slurry of paper pulp to flow from a headbox onto a moving wire. In the manufacture of sheet materials, a thickness-regulating member is normally used to insure that the thickness of the sheet is substantially uniform both in the direction in which the sheet travels and in the direction perpendicular thereto. In the case of paper, the thickness regulating member is called a slice lip and in the case of plastics, the thickness regulating member can be called a die. In either case, the position of the thickness-regulating member is controlled by actuators, which in the case of paper manufacturing include slice rods.

U.S. Pat. No. 3,413,192 teaches a system for controlling a thickness regulating member used in the manufacture of sheet products. According to the patent, a water slurry of fibrous paper stock is fed into a headbox, and the slurry then flows through a slice lip opening slot to be deposited in a continuous web onto a Fourdrinier wire which is continuously moving in a direction away from the headbox. The position of the slice lip is controlled by a plurality of actuators connected to the slice lip and to the headbox and spaced apart from one another along the length of the slice lip.

Further, according to the patent, the pape slurry dries as it travels along the Fourdriner wire and thereafter the paper web is fed between press rolls for removal of additional moisture. The web is then fed through a drier section, and the finished paper web issues from the drier. After the dried paper leaves the drier, a conventional basis weight measuring gauge including a source of nuclear radiation is used to measure the thickness of the web across the width thereof. Information from the measuring gauge is transmitted to a control system which in turn controls the slice actuators to maintain the thickness of the paper being produced according to a predetermined scheme.

One of the shortcomings of the system taught in the patent is that the physical characteristics of the slice lip and the actuators are not explicityly considered. It is believed that this leads to certain inaccuracies in the operation of the system.

OBJECTS OF THE INVENTION

An object of the present invention is to provide a system and process for controlling a thickness regulating member wherein the physical characteristics of the thickness regulating member are taken into consideration prior to using the system to control the manufacture of a sheet material.

Another object of the present invention is to provide a process for controlling the configuration of a thickness regulating member including determining at least one matrix by modeling the thickness-regulating member and actuator system as an elastic system without basing the determination on any of the following parameters: spring constants of the actuators, elastic modulus of the thickness-regulating member, and cross-sectional moment of inertia of the thickness regulating member.

Further objects and advantages of the present invention can be ascertained by reference to the specification and drawings which are offered by way of example and not in limitation of the invention which is defined by the claims and equivalents thereto.

DETAILED DESCRIPTION OF THE PREFERRED EMBODIMENT

Figure 1:
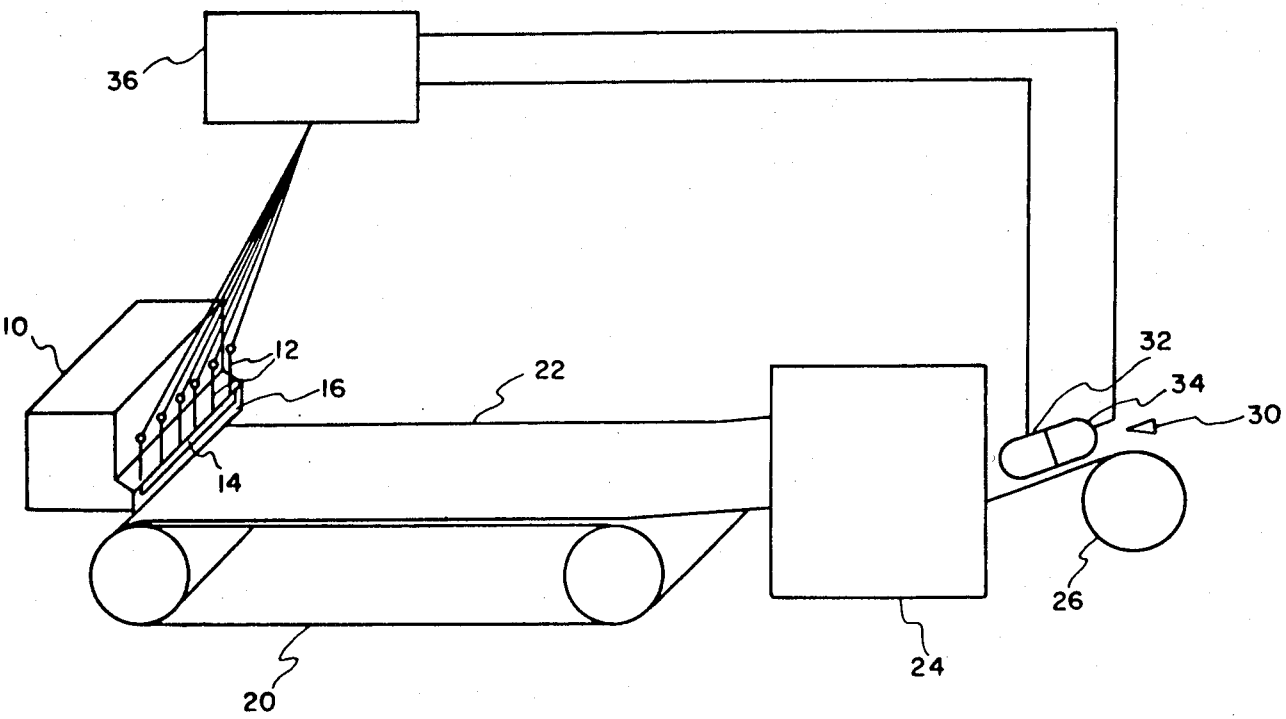
FIG. 1 is a schematic illustration of a paper making system according to one embodiment of the present invention.

As shown in FIG. 1, the present embodiment includes a headbox 10 to contain paper pulp. The headbox 10 includes a plurality of control members 12 coupled to a slice lip 14. Below the slice lip 14 is located the slice opening 16 through which the paper pulp is distributed onto a moving Fourdrinier wire 20. In accordance with conventional paper making processes the sheet of paper 22 is processed in a drier 24 and then rolled for shipment onto a reel 26. A scanner 30 is positioned across the sheet 22 near the reel 26. The scanner 30 is conventional and will not be described in detail herein. The scanner has two gauges, a basis weight gauge 32 and a moisture gauge 34, which move back and forth across the moving sheet and simultaneously measure the basis weight and moisture of the sheet. The gauges 32 and 34 produce electrical signals corresponding to the measured property of the sheet, and the electrical signals are transmitted to a controller 36. The controller 36 includes a computer to process information received from the gauges 32 and 34, and the controller also includes means coupled to the control members 12 to control the operation thereof.

Figure 2:
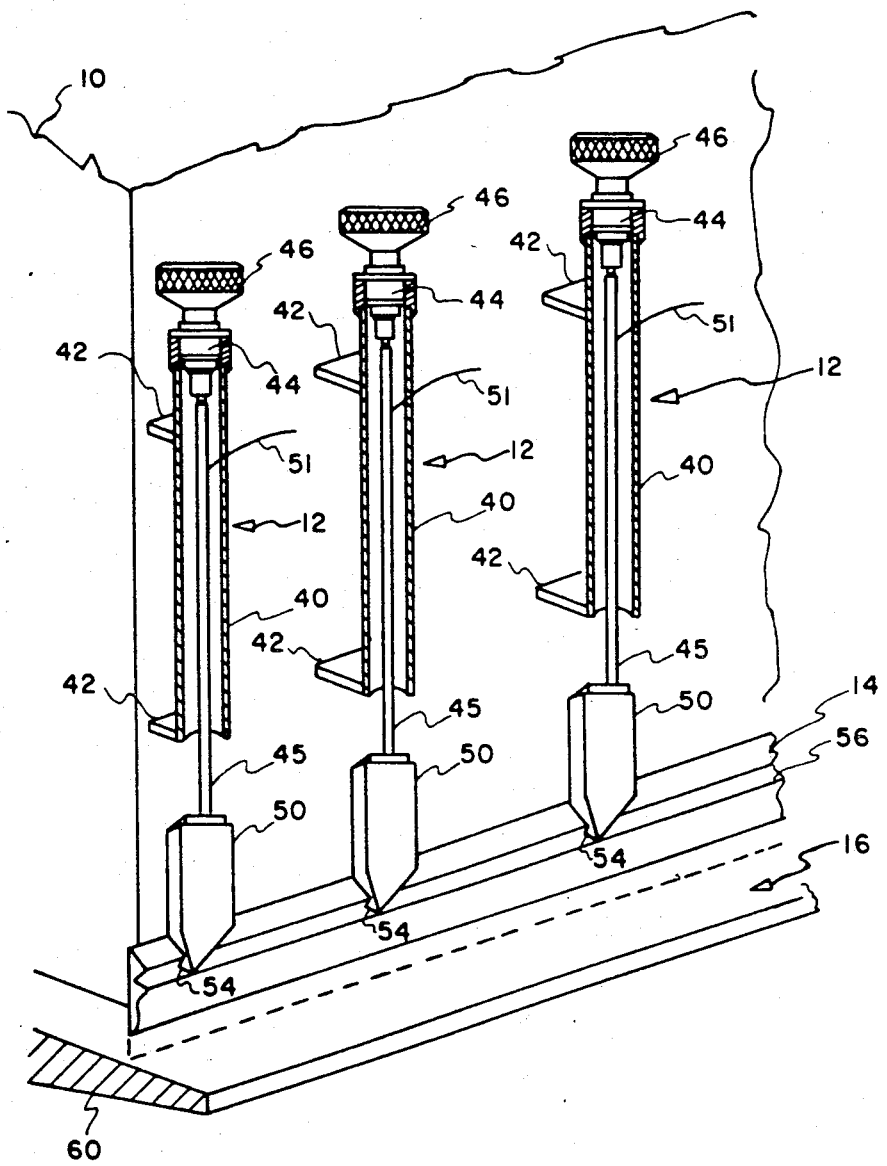
FIG. 2 is an expanded view of one part of the system shown in FIG. 1.

FIG. 2 shows details of the control members 12. Each member 12 includes a support tube 40 which is connected to the side of the headbox 10 by mounting brackets 42. A screw jack 44 is coupled to the upper end of the support tube 40, and a know 46 is coupled to the upper end of the screw 44. To the lower end of the screw jack 44 is coupled a slice rod or actuator 45 which includes a heating element, not shown. The slice rod 45 is hollow, and the heating element extends substantially the full length of the interior of slice rod 45. The heating element is a pair of elecrically insulated wires so that when current is applied the wires heat thereby heating the slice rod. A wire pair 51 is coupled to the heating element and extends out of the tube 40 for coupling to a power source.

Each connector 50 has a threaded hole, not shown, formed therein to accept a slice rod 45, and the rods 45 are threaded at their lower ends to permit the rods to be screwed into the connectors 50. Each connector 50 has a mounting member 54 formed on its lower end to cooperate with the slice lip 14.

When electric current is applied to the wires 51, the heating element is heated thus heating the rod 45 so that it expands and becomes longer, thus forcing the slice lip 14 downward. On the other hand, when no current is applied the heating element cools and the rod 45 contracts. For further discussion of the control members 12, see U.S. Pat. No. 4,406,740 titled "Apparatus for Effecting the Fine Adjustment of the Lip of a Headbox of a Paper Making Machine" assigned to Chleq Frote et Cie.

The slice lip 14 extends the length of the headbox and has a substantially flat side which fits flush against the front wall of the headbox 10. The opposing side of the slice lip 14 is curved and has a notch 56 to cooperate with the mounting member 54 so that vertical movements of a connector 50 results in corresponding vertical movement of the portion of the slice lip to which the connector is coupled. Behind the slice lip 14 the front face of the headbox 10 has a slice opening 16 to permit pulp to flow from the headbox onto the wire above a forming board 60. Thus it can be seen that the shape of the lower edge of the slice lip 14 determines the configuration of the flow of pulp from the slice opening 16. That is, if a portion of the slice lip 14 is raised, more pulp will be allowed to flow through the slice opening 16, and if a portion of the slice lip 14 is lowered toward the forming board 60, the slice opening will be correspondingly reduced in height thereby restricting the flow of pulp through the slice opening. Thus, it can be seen that the operation of the slice rods or actuators 45 can be used to control the basis weight of the paper measured by the gauge 32.

We have found that control of the actuators can advantageously be based upon certain information which is predetermined prior to operation of the system.

Prior to operation of the system, two matrices are determined.

$$R_a = \begin{bmatrix} 0 & . & . & . & . & . & . & 0 \\ 1 & -2 & 1 & 0 & . & . & . & 0 \\ 0 & 1 & -2 & 1 & 0 & . & . & 0 \\ . & . & . & . & . & . & . & . \\ . & . & . & . & . & . & . & . \\ 0 & . & . & . & 0 & 1 & -2 & 1 \\ 0 & . & . & . & . & . & . & 0 \end{bmatrix}$$

$[A] = [P_a][D_a]$ where:

$$P_a = \begin{bmatrix} 1 & 0 & 0 & . & . & . & . & 0 \\ 1 & 4 & 1 & 0 & . & . & . & 0 \\ . & . & . & . & . & . & . & . \\ 0 & 0 & . & . & . & 1 & 4 & 1 \\ 0 & 0 & . & . & . & . & 0 & 0 \end{bmatrix}$$

$$D_a = \begin{bmatrix} 0 & 1 & 2 & 3 & . & . & . & (n-1) \\ 0 & 0 & 1 & 2 & 3 & . & . & (n-2) \\ . & . & . & . & . & . & . & . \\ . & . & . & . & . & . & . & . \\ 0 & 0 & . & . & . & . & . & 1 \\ 1 & 1 & . & . & . & . & . & 1 \end{bmatrix}$$

n = the number of actuators coupled to the slice lip.

Each of the above matrices is derived by modelling the slice lip as an elastic beam supported by elastic supports and loaded at the actuators. Such systems are well analyzed in mechanical and civil engineering disciplines, and various approximations are well known. For the particular application for headbox slice lip control we have chosen an approximation which is to consider the slice lip as a slender elastic beam, and its deflections small with respect to its other dimensions. This allows approximation of the radius of curvature at any point of the beam as $1/R = y''$, where y is displacement, and allows expression of the relationship between the moment, M, and the curvature as $M = E\ I\ y''$, where E is the modulus of elasticity and I is the moment of inertia. In practice, the slice rods 45 are relatively thin and flexible. This allows for a reasonable assumption that the rods apply forces only, and the torques exerted by the rods are negligible. The behavior of the slice lip segments between two adjacent actuators can be expressed in terms of moments acting at the two ends of each segment. The neighboring ends of two adjacent segments must assure the continuity of the slice lip, and hence the positions and slopes at the neighboring ends must equal each other. This way one can express (n−1) relations, where (n) is the number of rods along the slice lip and where l is the distance between rods, as, $$l_i M_i + 2(l_i + l_{i+1}) M_{i+1} + l_{i+1} M_{i+2} = (6E I / l_i + l_{i+1})\,(l_{i+1} y_i - (l_i + l_{i+1} + l_i) y_{i+1} + l_i y_{i+2})$$

The moments arise primarily from the forces exerted by the rods and can be expressed in (n−1) equations as, $$M_i - M_{i-1} = l_1 F_1 + l_2 F_2 + \ldots + l_{i-1} F_{i-1}$$

In equilibrium, all forces acting on the slice lip must add up to zero, expressed as, $$F_1 + F_2 + \ldots + F_n = 0$$

Since the forces emerge due to the loading of the rods, causing them to deform practically in an elastic manner, $$F_i = k_i (z_i - y_i)$$

The collection of these equations can be solved to express the necessary displacement of the rods ($z_i$) to result in a slice lip shape ($y_i$).

Thus it can be seen that the matrices $R_a$, A, $P_a$ and $D_a$ are based upon the assumptions of equal spacing between the rods; all force on the slice lip is acting at the rods; and all rods are identical. In the event that any or all of these assumptions is not satisfied, different matrices could be computed. However, as a practical matter, we have found that the above-identified matrices would be applicable to most practical cases.

It can also be seen that the matrices are determined without basing the determination on any of the following parameters: spring constants of the slice rods, elastic modulus of the slice lip and cross-sectional moment of inertia of the slice lip.

Once matrices A and $R_a$ have been determined then certain physical parameters of the system must be detemined also. In particular, the following must be determined based upon a physical experiments or information from the manufacturer of the equipment.

E, the modulus of elasticity of the slice lip;

I, the cross sectional moment of inertia of the slice lip;

k, the spring constant of the slice rod 45;

l, the distance between slice rods.

Once this information has been determined or computed, the information is fed into the computer of the controller 36. Then the system can be installed in the field and operated according to the following equation:

$$\overline{Z} = [A]^{-1} \frac{6EI}{kl^3} [R_a] + [J]\,\overline{Y}$$

In this equation, $\overline{Z}$ equals a vector of the required slice rod movements $\overline{Y}$ equals a vector of required displacements of the thickness regulator member at each actuator, J equals the identity matrix and the other variables are as discussed above. In more general terms, the required slice rod movements are a function of the required displacements and physical parameters of the system, i.e.:

$$\overline{Z}=f(\overline{Y}, E, I, k, l)$$

Figure 3:
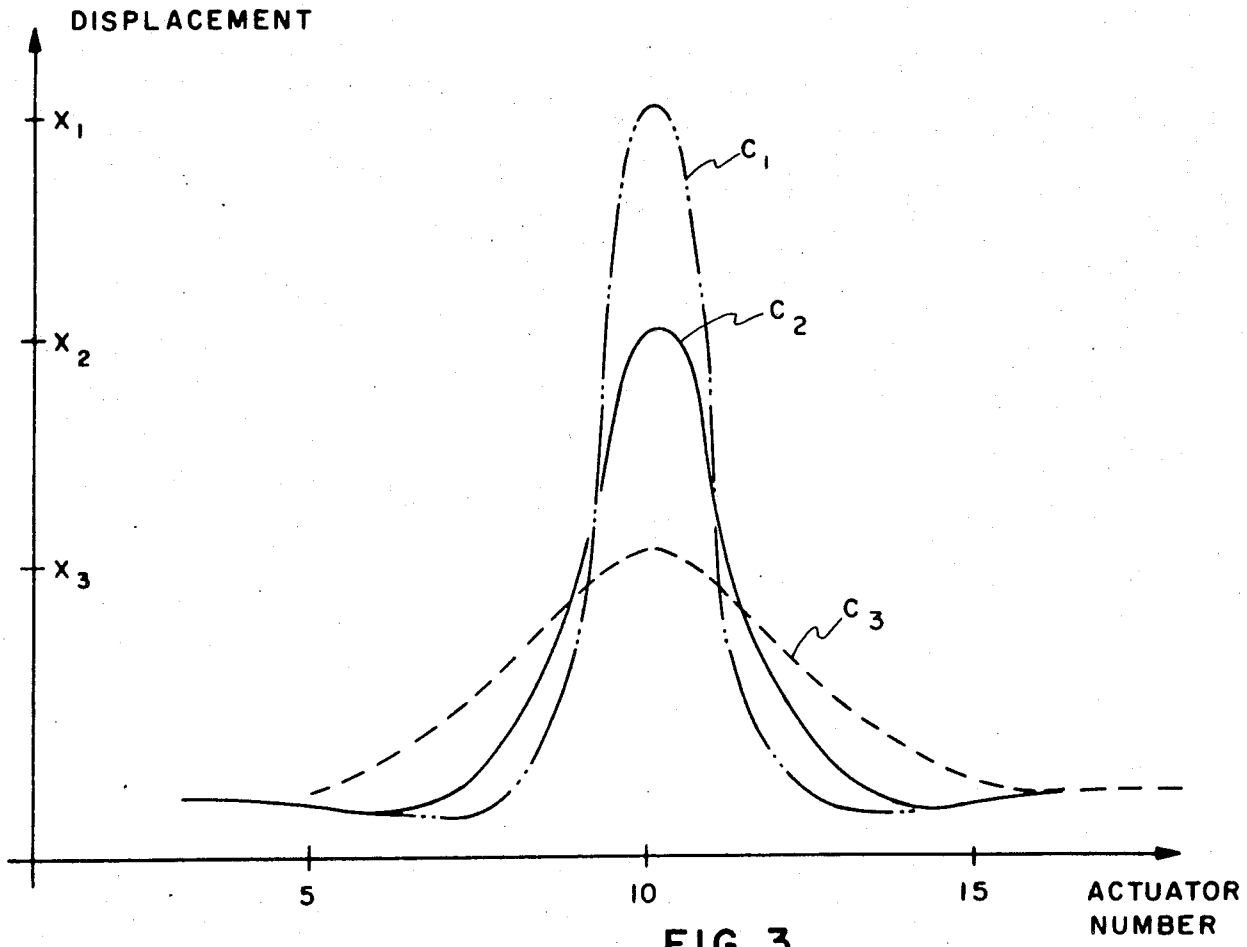
FIG. 3 is a graph illustrating one mode of operatin of the present embodiment.

In some circumstances, it may not be convenient to determine the parameters E, I, k based on data provided by the manufacturer of the hardware. In such cases, an operator in the field can utilzie the following procedure to develop a parameter c, which can be used in place of the parameters identified above. Specifically, with reference to FIG. 3, a series of curves have been developed showing rod number versus displacement of the slice lip when a single rod, for example, rod 10 is moved in one direction. Tests have shown that if the parameter c is a certain value, say C1, and rod 10 is displaced a distance X1 then the slice lip in the area adjacent the rod 10 will be displaced as shown on the curve C1. Likewise, if rod 10 is displaced a distance X2 then the slice lip adjacent the rod 10 will be displaced according to curve C2, and if parameter c has the value C3 and rod 10 is displaced a distance X3 then the slice lip will be displaced according to curve C3. Once the parameter C has been determined, then the following equation can be used to operate the system.

$$\overline{Z}=[A]^{-1}c[Ra]+[J]\overline{Y}$$

It should be understood that although one particular type of actuator is taught herein, the present invention is likewise applicable to other types of actuators. For example, plastic extruders and other sheet material processes employing actuators of the type taught herein or actuators which are hydraulically powered or motor driven are appropriate for application of the present invention.

We claim:

1. A process for controlling the configuration of a thickness-regulating member which is coupled to a plurality of actuators, the process comprising:

(a) determining the desired configuration of the thrickness-regulating member;

(b) determining the actuator movements required to substantially obtain the desired configuration of the thickness-regulating member according to the following equation:

$$\overline{Z} = [A]^{-1} \frac{6EI}{Kl^3} [Ra] + [J]\,\overline{Y}$$

where:

$\overline{Z}$=required actuator movements;

$\overline{Y}$=required displacements of the thickness-regulating member at each actuator;

E=modulus of elasticity of the thickness-regulating member;

I=cross-sectional moment of inertia of the thickness-regulating member;

k=spring constant of an actuator;

l=distance between actuators;

[A]=a first predetermined matrix;

[J]=identity matrix;

[Ra]=a second predetermined matrix;

wherein said first and second predetermined matrices are determined by modeling a thickness-regulating member and actuator system as an elastic system, without basing the determination on any of the following parameters: spring constants of the actuators, elastic modulus of the thickness-regulating member, and cross-sectional moment of inertia of the thickness-regulating member; and, (c) controlling the actuators based upon the required actuator movements.

2. A process according to claim 1 wherein, $[A] = [P_a][D_a]$ where:

$$P_a = \begin{bmatrix} 1 & 0 & 0 & . & . & . & . & 0 \\ 1 & 4 & 1 & 0 & . & . & . & 0 \\ . & . & . & . & . & . & . & . \\ 0 & 0 & . & . & . & 1 & 4 & 1 \\ 0 & 0 & . & . & . & . & 0 & 0 \end{bmatrix}$$

$$D_a = \begin{bmatrix} 0 & 1 & 2 & 3 & . & . & . & (n-1) \\ 0 & 0 & 1 & 2 & 3 & . & . & (n-2) \\ . & . & . & . & . & . & . & . \\ . & . & . & . & . & . & . & . \\ 0 & 0 & . & . & . & . & . & 1 \\ 1 & 1 & . & . & . & . & . & 1 \end{bmatrix}$$

n=number of actuators.

3. A process according to claim 1 wherein:

$$R_a = \begin{bmatrix} 0 & . & . & . & . & . & . & 0 \\ 1 & -2 & 1 & 0 & . & . & . & 0 \\ 0 & 1 & -2 & 1 & 0 & . & . & 0 \\ . & . & . & . & . & . & . & . \\ . & . & . & . & . & . & . & . \\ 0 & . & . & . & 0 & 1 & -2 & 1 \\ 0 & . & . & . & . & . & . & 0 \end{bmatrix}$$

4. A process for controlling the configuration of a thickness-regulating member which is coupled to a plurality of actuators, the process comprising:

(a) determining at least one matrix by modeling a thickness-regulating member and actuator system as an elastic system, said determination being made without basing the determination on any of the following parameters: spring constants of the actuators, elastic modulus of the thickness-regulating member, and cross sectional moment of inertia of the thickness-regulating member;

(b) determining the desired configuration of the thickness-regulating member;

(c) determining actuator movements required to substantially obtain the desired configuration of the thickness-regulating member based upon the determined at least one matrix; and (d) controlling the actuators based upon the required movements.

5. A process according to claim 4 wherein the thickness-regulating member is a slice lip.

* * * * *